US008997379B2

(12) United States Patent
Reinhardt et al.

(10) Patent No.: US 8,997,379 B2
(45) Date of Patent: Apr. 7, 2015

(54) INLAY SOLE FOR SHOES

(75) Inventors: Holger Reinhardt, Kempen (DE); Ralf Lang, Heiligenhaus (DE); Michel Vanfleteren, Tönisvorst (DE)

(73) Assignee: Bauerfeind AG, Zeulenroda (DE)

( * ) Notice: Subject to any disclaimer, the term of this patent is extended or adjusted under 35 U.S.C. 154(b) by 1019 days.

(21) Appl. No.: 12/085,515

(22) PCT Filed: Nov. 27, 2006

(86) PCT No.: PCT/EP2006/011369

§ 371 (c)(1),
(2), (4) Date: Jul. 24, 2008

(87) PCT Pub. No.: WO2007/062793

PCT Pub. Date: Jun. 7, 2007

(65) Prior Publication Data

US 2009/0260257 A1 Oct. 22, 2009

(30) Foreign Application Priority Data

Dec. 2, 2005 (DE) ..... 20 2005 018 902 U

(51) Int. Cl.

| | |
|---|---|
| ***A43B 1/00*** | (2006.01) |
| ***A43B 13/00*** | (2006.01) |
| ***A43B 13/18*** | (2006.01) |
| ***A43B 7/14*** | (2006.01) |
| ***A43B 13/16*** | (2006.01) |

(52) U.S. Cl.

CPC ..... *A43B 13/188* (2013.01); *A43B 7/1465* (2013.01); *A43B 13/16* (2013.01)

(58) Field of Classification Search

USPC ..... 36/43, 44, 71, 103, 31, 15; D2/961

See application file for complete search history.

(56) References Cited

U.S. PATENT DOCUMENTS

| | | | | | |
|---|---|---|---|---|---|
| 190,113 | A | * | 5/1877 | Arnold | 36/34 R |
| 217,123 | A | * | 7/1879 | Locke | 36/34 R |
| 2,046,732 | A | * | 7/1936 | Fein | 36/43 |
| 2,237,892 | A | * | 4/1941 | Squire | 36/43 |
| 2,369,531 | A | * | 2/1945 | Caltabiano | 36/31 |
| 4,551,930 | A | * | 11/1985 | Graham et al. | 36/30 R |
| 4,557,060 | A | * | 12/1985 | Kawashima | 36/44 |
| 4,633,877 | A | | 1/1987 | Pendergast | |
| 4,783,910 | A | * | 11/1988 | Boys et al. | 36/107 |
| 5,014,706 | A | * | 5/1991 | Philipp | 36/140 |
| 5,768,803 | A | * | 6/1998 | Levy | 36/43 |
| 5,832,634 | A | * | 11/1998 | Wong | 36/107 |

(Continued)

FOREIGN PATENT DOCUMENTS

| | | |
|---|---|---|
| DE | 3639505 A1 | 6/1988 |
| DE | 90 00 961.4 | 6/1990 |

(Continued)

*Primary Examiner* — Clinton T Ostrup
*Assistant Examiner* — Catherine M Ferreira
(74) *Attorney, Agent, or Firm* — Birch, Stewart, Kolasch & Birch, LLP

(57) ABSTRACT

An inlay sole for shoes is made up of sole pieces of varying Shore hardness which engage with each other on abutting edges, the width of which corresponds to the thickness of the sole pieces, with matching sinuous projections and matching recesses. The projections form extensions which engage in backcuts in the recesses, the inlay sole being made of several layers of sole pieces assembled as above. The abutting edges are offset with relation to each other from layer to layer.

17 Claims, 2 Drawing Sheets

(56) References Cited

U.S. PATENT DOCUMENTS

| | | | | | |
|---|---|---|---|---|---|
| D407,191 | S | * | 3/1999 | McKenzie, Jr. | D2/952 |
| 5,976,100 | A | * | 11/1999 | Greenawalt | 602/66 |
| 6,061,929 | A | * | 5/2000 | Ritter | 36/107 |
| 6,082,023 | A | * | 7/2000 | Dalton | 36/28 |
| 6,151,803 | A | * | 11/2000 | Charles | 36/72 R |
| 6,510,626 | B1 | * | 1/2003 | Greenawalt | 36/43 |
| 6,775,930 | B2 | * | 8/2004 | Fuerst | 36/103 |
| 7,210,250 | B2 | * | 5/2007 | Gallegos | 36/44 |
| D581,643 | S | * | 12/2008 | Bauerfeind et al. | D2/961 |
| 7,464,490 | B2 | * | 12/2008 | Lebo | 36/30 R |
| 8,320,619 | B2 | * | 11/2012 | Mathe | 382/103 |
| 2005/0262740 | A1 | | 12/2005 | Salvatelli et al. | |
| 2006/0277796 | A1 | * | 12/2006 | Gallegos | 36/44 |

FOREIGN PATENT DOCUMENTS

| | | | |
|---|---|---|---|
| DE | 296 16 037 | U1 | 1/1997 |
| EP | 1 593 360 | A2 | 11/2005 |
| FR | 2 522 482 | A1 | 9/1983 |
| GB | 474071 | A | 10/1937 |
| WO | WO-2005/058085 | A1 | 6/2005 |
| WO | WO-2006/035469 | A2 | 4/2006 |

* cited by examiner

INLAY SOLE FOR SHOES

CROSS-REFERENCE TO RELATED APPLICATION

The present application claims priority under 35 U.S.C. §119 to German Patent Application No. 202005018902.2, filed Dec. 2, 2005, and International Application PCT/FP2006/011369 filed Nov. 27, 2006.

BACKGROUND OF THE INVENTION

1. Field of the Invention

The invention relates to an inlay sole for shoes, consisting of sole parts of different Shore hardness, wherein, at abutting edges, the width of which edges corresponds to the thickness of the sole parts, said sole parts are interlocked with each other in sinuously conjoining manner by means of projections and matching recesses, such that the projections form extensions that engage undercuts in the recesses, the inlay sole consisting of a plurality of layers of thus assembled sole parts.

2. Description of Background Art

Such inlay soles are often used to provide a pleasant contact between the shoe and the wearer's foot, for which purpose an especially elastic material is employed for the inlay sole. Such elasticity is referred to in known manner as Shore hardness. Inlay soles are additionally used for therapeutic purposes, more particularly in order to provide especially soft cushioning at certain points, for which purpose an especially soft material is then inserted into the inlay sole at the relevant point.

In a heel bed confined to the heel according to DE-GBM 298 06 187.2, the material of the heel bed is provided in the region of an existing heel spur with a sunk-in cushion which does not project out of the heel bed, i.e. which forms virtually an even surface with the heel bed. Said cushion has greater elasticity than the material of the heel bed, with the result that a heel spur is cushioned by a suitably soft region of the heel bed without a particularly high pressure being exerted on the heel spur. The cushion, which is sunk into the material of the heel bed, transitions via a serrated edge into the material of the heel bed, thereby providing a transitional zone between the cushion and the material of the heel bed in which, owing to said interlocking, the elasticity is perceived by the wearer as a transition of elasticity.

An inlay sole having the initially indicated design features is presented in FIGS. 9 and 10 of EP 1 593 360 A2, it being mentioned in the description that individual soles can be laid one on the other. The abutting sole parts have different mechanical characteristics, this allowing them to be adapted to particular needs of the person wearing shoes with such inlay soles. Where identical soles of identical inner design are laid one on the other, this results, in comparison with just one sole, at the superposed abutting edges of the sole parts in a correspondingly abrupt transition of hardness which is especially perceptible for the wearer.

SUMMARY AND OBJECTS OF THE INVENTION

The object of the invention is to even out the transition of Shore hardness from sole part to sole part, this providing particular comfort to the user of such an inlay sole. The object of the invention is achieved in that the respective abutting edges are offset with respect to each other from layer to layer.

The fact that the sole parts are offset from layer to layer provides a wide scope for varying the abruptness of transition of the sole hardness along the entire inlay sole, wherein the existing distance between the respective abutting edges from layer to layer makes it possible to achieve a more or less gentle transition of the Shore hardness from sole part to sole part.

For inlay soles of especially great thickness, it is sufficient for them to be held together by their abutting edges with the respectively overlapping projections, without there being any additional need for special gluing of the abutting edges. However, it is also possible for the connection between the individual sole parts by means of the abutting edges to be particularly further enhanced by providing the abutting edges with an adhesive, said adhesive additionally resulting in a lasting connection between adjacent sole parts. Preferably entering into consideration for this purpose is an adhesive that remains elastic upon setting. Furthermore, the connection between the individual sole parts can be accomplished by an overlay, said overlay extending over the sole parts. Such an overlay is advantageously glued onto the assembled sole parts. The overlay may also be in the form of a sole support with a supporting effect, said sole support lending special support in particular to the metatarsus.

Where there are two adjacent layers of assembled sole parts, a sole support can advantageously be accommodated between the two layers, this resulting in an inlay sole with integral sole support, wherein the sole support can, in this case, be adapted to the particular shape of the user's foot, being more particularly of a special shape in order to support the foot with an especially desired therapeutic effect.

BRIEF DESCRIPTION OF THE DRAWINGS

An illustrative embodiment of the invention is presented in the drawings, in which.

DETAILED DESCRIPTION OF THE PREFERRED EMBODIMENTS

Figure 1:
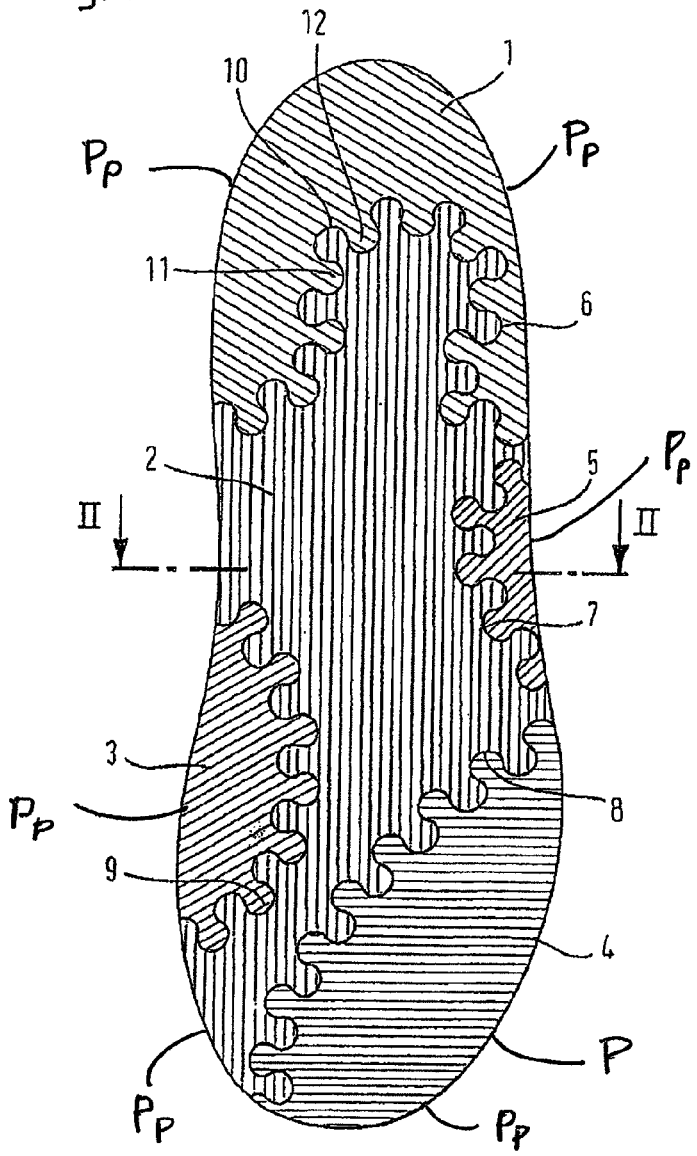
FIG. 1 shows a top plan view of an individual inlay sole consisting of five sole parts.

FIG. 1 presents a top plan view of the inlay sole with five sole parts 1, 2, 3, 4 and 5, all of which sole parts are of different Shore hardness. As an example, in the inlay sole presented in FIG. 1, sole part 1 is of a material of high Shore hardness; sole part 2 is of a material of medium Shore hardness; and sole parts 3, 4 and 5 are of a material of low Shore hardness. Of course, the sole parts can also be differently arranged with respect to each other within the inlay sole, it likewise being possible for there to be a different number of sole parts. More particularly, it is possible for the inlay sole to be composed of just sole parts 1, 2 and 4, i.e. for sole parts 3 and 5 to be omitted, it also being possible, of course, for the abutting edges 6, 7, 8 and 9 to be differently positioned in order to suit the specific therapeutic purpose. As can be seen in FIG. 1, each of the sole parts 1, 2, 3, 4, 5 has a different surface area. In addition, each of the sole parts 1, 2, 3, 4, 5 has a curved peripheral portion Pp.

The abutting edges 6, 7, 8 and 9 are so formed as to, as it were, wedge into each other, i.e. the projections 10 of each sole part engage between the projections 11 and 12 of the adjacent sole part, as is the case with the two sole parts 1 and 2. On account of the shapes of the projections along the abutting edges 6, 7, 8 and 9, the extensions of the projections (e.g. 10) are matched by undercuts on the respective adjacent projections, with the consequence that the thus shaped abutting edges 6, 7, 8 and 9 result in the interlocking of adjacent sole parts, said interlocking making it virtually impossible for the individual sole parts 1, 2, 3, 4 and 5 to be pulled apart, the inlay sole thereby assuming the form of a single unit. In addition, of course, it is possible for an adhesive to be inserted along the abutting edges 6, 7, 8 and 9.

Figure 2:
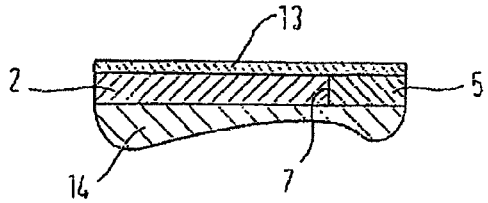
FIG. 2 shows a section along line II-II from FIG. 1.

FIG. 2 presents a section along line II-II from FIG. 1, where said section traverses sole parts 5 and 2. The sectional representation in FIG. 2 illustrates that each sole part extends over the entire thickness of sole parts 5 and 2. Of course, the same is true of the other sole parts. FIG. 2 further presents the overlay 13, which covers the entire inlay sole on the upper side of sole parts 2 and 5 facing the wearer's foot. Such an overlay serves in known manner to improve the foot climate in the shoe and is preferably glued onto the sole parts.

Figure 3:
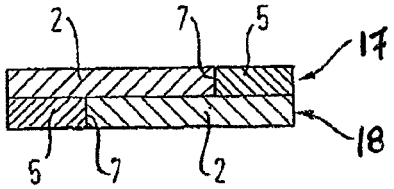
FIG. 3 shows a section through a two-layer inlay sole with abutting edges offset with respect to each other.

FIG. 2 additionally presents a sole support 14, which sole support 14 provides the inlay sole with a desired supporting curvature of the type employed in known inlay soles. The principal purpose of such a sole support is to provide particular support for the metatarsus. In this case, the sole support 14 is attached by permanent connection to the undersides of sole parts 2 and 5 and, of course, also to the other sole parts.

Where soft transitions are desired from sole part to sole part, the individual layers are so assembled as presented in FIG. 3. The two layers 17 and 18 comprise sole parts 2 and 5, which are offset with respect to each other, so that the respective abutting edges 7 are at a distance from each other, this resulting in a transition of softness from sole part 2 to sole part 5 at the respective abutting edge 7 as a consequence of the other sole part. The individual sole parts can be suitably relocated from layer 17 to layer 18, depending on the desired characteristics of said transition. As can be understood, when the assembled inlay sole is viewed in side elevation view, each of the abutting edges 6, 7, 8, 9, at a periphery P of the inlay sole is seen to extend substantially orthogonally relative to upper and lower surfaces of the inlay sole, and each of the abutting edges of the upper layer 17 is offset with respect to each of the abutting edges of the lower layer 18.

Figure 4:
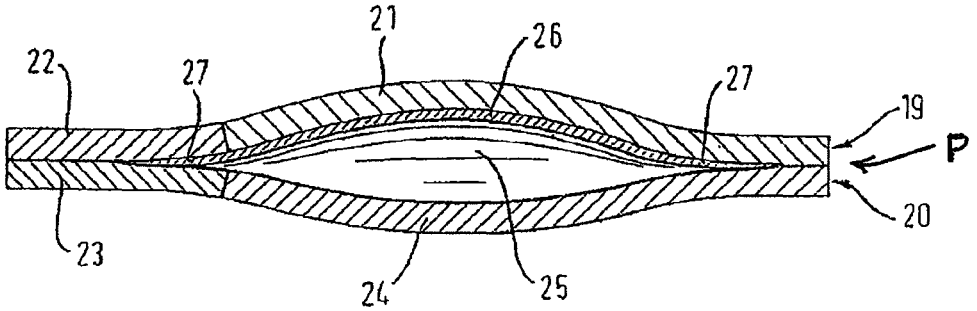
FIG. 4 shows a section through an inlay sole with a sole support enclosed by two layers.

An inlay sole composed of two layers is also especially well suited to enclose a sole support. Such an arrangement is presented in FIG. 4. The two layers 19 and 20 with their sole parts 21, 22, 23 and 24 enclose the sole support 25, the support plate 26 of said sole support 25 being shown in section. Said support plate 26 is supported at its ends 27, 27 in known manner in the direction of the shoe and thus carries the upper layer 19. With such an arrangement as presented in FIG. 4, it is possible in especially advantageous manner to combine the effect of the two individual layers 19 and 20 with a sole support, namely the sole support 25, this resulting in an inlay sole with a particularly supportive effect.

What is claimed is:

1. An inlay sole for shoes, comprising:

an upper layer mounted atop a lower layer, each of the layers being assembled of multiple sole parts, each of the sole parts having a thickness, wherein the thicknesses of the upper layer and the lower layer are substantially equal to each other, and each of the sole parts having a Shore hardness, wherein the hardnesses are not all equal to each other, wherein each of the multiple soles parts has one or more abutting edges, each of the abutting edges having a continuously curving shape which provides each of the abutting edges with multiple projections and matching recesses arranged alternately along a length thereof, wherein each of the multiple sole parts of the upper layer is interlocked with at least one of the other multiple sole parts in a sinuously conjoining manner by having the multiple projections of each of the multiple sole parts interlocked with corresponding matching recesses of each adjoining one of the other multiple sole parts in order to form the assembled upper layer, and each of the multiple sole parts of the lower layer is interlocked with at least one of the other multiple sole parts in a sinuously conjoining manner by having the multiple projections of each of the multiple sole parts interlocked with the corresponding matching recesses of each adjoining one of the other multiple sole parts in order to form the assembled lower layer, wherein an outer periphery of the assembled upper layer is formed by an outer peripheral portion of each of the multiple sole parts which form the assembled upper layer, and an outer periphery of the assembled lower layer is formed by an outer peripheral portion of each of the multiple sole parts which form the assembled lower layer, and the outer periphery and size of the assembled upper layer are equal to the outer periphery and size of the assembled lower layer, thereby enabling the assembled upper layer to completely cover an upper surface of the assembled lower layer, wherein the abutting edges of the multiple sole parts of the assembled upper layer form a single curved surface arranged orthogonally relative to upper and lower surfaces of the assembled timer layer, the abutting edges of the multiple sole parts of the assembled lower layer form a single curved surface arranged orthogonally relative to upper and lower surfaces of the assembled lower layer, and each of the abutting edges of the multiple sole parts of the assembled upper layer is offset with respect to each of the abutting edges of the multiple sole parts of the assembled lower layer, and wherein at least a first one of the sole parts in each of the layers has a first Shoe hardness and an abutting edge which abuts against another of the abutting edges of a second one of the sole parts having a second Shore hardness, the second Shore hardness being higher than the first Shore hardness, and since each of the abutting edges of the assembled upper layer is offset with respect to each of the abutting edges of the assembled lower layer, a portion of the second sole part of the upper layer that is located directly above a portion of the first sole part of the lower layer forms a soft transition area of the inlay sole, the soft transition area having greater softness as compared to other areas of the inlay sole where another portion of the second sole part of the upper layer is located, wherein the second sole part is located at a central portion of the inlay sole.

2. The inlay sole according to claim 1, further comprising a first sole support having an exposed lower surface and a smooth upper surface fixed to a smooth lower surface of the assembled lower layer.

3. The inlay sole according to claim 1, further comprising a second sole support arranged between the assembled upper and lower layers.

4. The inlay sole according to claim 1, further comprising:

a support plate between a second sole support and the upper layer, wherein each of the second sole support and the support plate is located entirely inward with respect to the outer periphery of the inlay sole.

5. The inlay sole according to claim 1, wherein the multiple sole parts of the assembled upper layer consist of five sole parts, each of which has a different surface area, and the multiple sole parts of the assembled lower layer consist of five sole parts, each of which has a different surface area.

6. The inlay sole according to claim 1, wherein the multiple sole parts of the assembled upper layer include the first sole part, the second sole part, a third sole part, a fourth sole part, and a fifth sole part, each having a different surface area, wherein the outer periphery of the assembled upper layer is formed by four different peripheral portions of the first sole part of the assembled upper layer, and one peripheral portion of each of the second sole part, the third sole part, the fourth sole part, and the fifth sole part, wherein two of the peripheral portions of the first sole part are arranged on one lateral side of the inlay sole, and two others of the peripheral portions of the first sole part are arranged on an opposite lateral side of the inlay sole, wherein the multiple sole parts on the assembled upper layer consist of a first sole part, a second sole part, a third sole part, a fourth sole part, and a fifth sole part, each having a different surface area, wherein the outer periphery of the assembled upper layer is formed by four different peripheral portions of the first sole part of the assembled upper layer, and one peripheral portion of each of the second sole part, the third sole part, the fourth sole part, and the fifth sole part.

7. An inlay sole for shoes, comprising:

an upper layer mounted atop a lower layer, each of the layers being assembled of multiple sole parts, each of the multiple sole parts having a thickness, wherein the thicknesses of the upper layer and the lower layer are substantially equal to each other, and each of the sole parts having a Shore hardness, wherein the hardnesses are not all equal to each other, wherein each of the multiple soles parts has one or more abutting edges, each of the abutting edges having a continuously curving shape which provides each of the abutting edges with multiple projections and matching recesses arranged alternately along a length thereof, wherein each of the multiple sole parts of the upper layer is interlocked with at least one of the other multiple sole parts in a sinuously conjoining manner by having the multiple projections interlocked with corresponding matching recesses of each of the other multiple sole parts of the upper layer in order to form the assembled upper layer, and each of the multiple sole parts of the lower layer is interlocked with at least one of the other multiple sole parts in a sinuously conjoining manner by having the multiple projections interlocked with the corresponding matching recesses of each of the other multiple sole parts of the lower layer in order to form the assembled lower layer, the abutting edges of the multiple sole parts of the assembled upper layer form a single curved surface arranged orthogonally relative to upper and lower surfaces of the assembled upper layer, the abutting edges of the multiple sole parts of the assembled lower layer form a single curved surface arranged orthogonally relative to upper and lower surfaces of the assembled lower layer, and each of the abutting edges of the multiple sole parts of the assembled upper layer is offset with respect to each of the abutting edges of multiple sole parts of the assembled lower layer.

8. The inlay sole according to claim 7, wherein the multiple sole parts of the assembled upper layer include the first sole part, the second sole part, a third sole part, a fourth sole part, and a fifth sole part, each having a different surface area, wherein the outer periphery of the assembled upper layer is formed by four different peripheral portions of the first sole part of the assembled upper layer, and one peripheral portion of each of the second sole part, the third sole part, the fourth sole part, and the fifth sole part, wherein two of the peripheral portions of the first sole part are arranged on one lateral side of the inlay sole, and two others of the peripheral portions of the first sole part are arranged on an opposite lateral side of the inlay sole.

9. An inlay sole for shoes, comprising:

an assembled upper layer mounted atop an assembled lower layer, each of the layers being assembled of multiple sole parts, each of the multiple sole parts having a thickness, wherein the thicknesses of the upper layer and the lower layer are substantially equal to each other, and each of the multiple sole parts having a Shore hardness, wherein at least three of the multiple sole parts have the Shore hardnesses that are not all equal to each other, wherein each of the multiple soles parts has one or more abutting edges, each of the abutting edges having a continuously curving shape which provides each of the abutting edges with multiple projections and matching recesses arranged alternately along a length thereof, wherein one of the multiple sole parts of the upper layer is interlocked with each of the other multiple soles parts in a sinuously conjoining manner by having the multiple projections interlocked with corresponding matching recesses of each of the other multiple sole parts of the upper layer in order to form the assembled upper layer, and one of the multiple sole parts of the lower layer is interlocked with each of the other multiple soles parts in a sinuously conjoining manner by having the multiple projections interlocked with the corresponding matching recesses of each of the other multiple sole parts of the lower layer in order to form the assembled lower layer, wherein one of the multiple sole parts is a heel sole part adapted to support a heel of a foot of a person, the heel sole part has a U-shaped outer periphery, and a concave inner periphery, wherein the abutting edges of the multiple sole parts of the assembled upper layer form a single curved surface arranged orthogonally relative to upper and lower surfaces of the assembled upper layer, the abutting edges of the multiple sole parts of the assembled lower layer form a single curved surface arranged orthogonally relative to upper and lower surfaces of the assembled lower layer, and each of the abutting edges of the multiple sole parts of the assembled upper layer is offset with respect to each of the abutting edges of the multiple sole parts of the assembled lower layer, and wherein at least a first one of the sole parts in each of the layers has a first Shore hardness and an abutting edge which abuts against another of the abutting edges of a second one of the sole parts having a second Shore hardness, the second Shore hardness being higher than the first Shore hardness, and since each of the abutting edges of the assembled upper layer is offset with respect to each of the abutting edges of the assembled lower layer, a portion of the second sole part of the upper layer that is located directly above a portion of the first sole part of the lower layer forms a soft transition area of the inlay sole, the soft transition area having greater softness as compared to other areas of the inlay sole where another portion of the second sole art of the upper layer is located, wherein the second sole part is located at a central portion of the inlay sole.

10. The inlay sole according to claim 9, further comprising a first sole support having an exposed lower surface and a smooth upper surface fixed to a smooth lower surface of the lower layer.

11. The inlay sole according to claim 9, wherein at least one of the projections or the recesses arranged internally with respect to the to opposite sides of the U-shaped outer periphery of the heel sole part extends in a direction that is perpendicular to the opposite sides of the U-shaped outer periphery of the heel sole part.

12. The inlay sole according to claim 11, further comprising a first sole support having an exposed lower surface and a smooth upper surface fixed to a smooth lower surface of the assembled lower layer.

13. The inlay sole according to claim 9, further comprising:

a support plate between a second sole support and the assembled upper layer, wherein each of the second sole support and the support plate is located entirely inward with respect to an outer periphery of the inlay sole.

14. The inlay sole according to claim 9, wherein the first part in each of the layers has a first Shore hardness and an abutting edge which abuts against an abutting edge of the second sole part having a second Shore hardness, the second Shore hardness being higher than the first Shore hardness, and since each of the abutting edges of the assembled upper layer is offset with respect to each of the abutting edges of the assembled lower layer, a portion of the second sole part of the upper layer that is located directly above a portion of the first sole part of the lower layer forms a soft transition area of the inlay sole, the soft transition area having greater softness as compared to other areas of the inlay sole where another portion of the second sole part of the upper layer is located, wherein the second sole part is located at a central portion of the inlay sole and has a Shore hardness that is greater than the Shore hardness of the sole part at a front tip of the inlay sole, and is less than the Shore hardness of the sole part at a rear tip of the inlay sole.

15. The inlay sole according to claim 9, wherein the multiple sole parts of the assembled upper layer include the first sole part, the second sole part, a third sole part, a fourth sole part, and a fifth sole part, each having a different surface area, wherein the outer periphery of the assembled upper layer is formed by four different peripheral portions of the first sole part of the assembled upper layer, and one peripheral portion of each of the second sole part, the third sole part, the fourth sole part, and the fifth sole part, wherein two of the peripheral portions of the first sole part are arranged on one lateral side of the inlay sole, and two others of the peripheral portions of the first sole part are arranged on an opposite lateral side of the inlay sole.

16. An inlay sole for shoes, comprising:

an upper layer arranged above a lower layer, each of the layers being assembled of multiple sole parts, each of the sole parts having a thickness, wherein the thicknesses of the upper layer and the lower layer are substantially equal to each other, and each of the sole parts having a Shore hardness, wherein at least three of the multiple sole parts have the Shore hardnesses that are not all equal to each other, wherein each of the multiple soles parts has one or more abutting edges, each of the abutting edges having a continuously curving shape which provides each of the abutting edges with multiple projections and matching recesses arranged alternately along a length thereof, wherein one of the multiple sole parts of the upper layer is interlocked with each of the other multiple soles parts in a sinuously conjoining manner by having the multiple projections of each of the multiple sole parts interlocked with corresponding matching recesses of each of the other multiple sole parts of the upper layer in order to form the assembled upper layer, and one of the multiple sole parts of the lower layer is interlocked with each one of the other multiple soles parts in a sinuously conjoining manner by having the multiple projections of each of the multiple sole parts interlocked with the corresponding matching recesses of each of the other multiple sole parts of the lower layer in order to form the assembled lower layer, wherein the multiple sole parts of the assembled upper layer include a first sole part, a second sole part, a third sole part, a fourth sole part, and a fifth sole part, each having a different surface area, wherein the outer periphery of the assembled upper layer is formed by four different peripheral portions of the first sole part, and one peripheral portion of each of the second sole part, the third sole part, the fourth sole part, and the fifth sole part, wherein two of the peripheral portions of the first sole part are arranged on one lateral side of the inlay sole, and two others of the peripheral portions of the first sole part are arranged on an opposite lateral side of the inlay sole, wherein the abutting edges of the multiple sole parts of the assembled upper layer form a single curved surface arranged orthogonally relative to upper and lower surfaces of the assembled upper layer, the abutting edges of the multiple sole parts of the assembled lower layer form a single curved surface arranged orthogonally relative to upper and lower surfaces of the assembled lower layer, and each of the abutting edges of the multiple sole arts of the assembled upper layer is offset with respect to each of the abutting edges of the multiple sole parts of the assembled lower layer, and wherein at least a first one of the sole parts in each of the layers has a first Shore hardness and an abutting edge which abuts against another of the abutting edges of a second one of the sole parts having a second Shore hardness, the second Shore hardness being higher than the first Shore hardness, and since each of the abutting edges of the assembled upper layer is offset with respect to each of the abutting edges of the assembled lower layer, a portion of the second pole part of the upper layer that is located directly above a portion of the first sole part of the lower layer forms a soft transition area of the inlay sole, the soft transition area having greater softness as compared to other areas of the inlay sole where another portion of the second sole part of the upper layer is located, wherein the second sole part is located at a central portion of the inlay sole.

17. The inlay sole according to claim 16, wherein each of the multiple sole parts consists of five sole parts of the assembled upper layer, each of which has a different area, and five sole parts on the assembled lower layer, each of which has a different area, and one of the five sole parts in each of the assembled layers is sinuously conjoined with each of the other multiple sole parts, and each of the other five sole parts is sinuously conjoined only to the one of the multiple sole parts.

* * * * *